US005845547A

United States Patent [19]

Sollami

[11] Patent Number: 5,845,547

[45] Date of Patent: Dec. 8, 1998

[54] TOOL HAVING A TUNGSTEN CARBIDE INSERT

[75] Inventor: Phillip A. Sollami, Herrin, Ill.

[73] Assignee: The Sollami Company, Herrin, Ill.

[21] Appl. No.: 808,360

[22] Filed: Feb. 28, 1997

Related U.S. Application Data

[63] Continuation-in-part of Ser. No. 709,310, Sep. 9, 1996.

[51] Int. Cl.[6] ..... B21K 5/04

[52] U.S. Cl. ..... 76/108.2; 76/101.1; 76/DIG. 11; 175/420.1; 419/38

[58] Field of Search ..... 26/108.2, DIG. 11, 26/108.1; 419/18.38; 175/420.1, 426; 76/101.1

[56] References Cited

U.S. PATENT DOCUMENTS

| | | | |
|---|---|---|---|
| 3,581,835 | 6/1971 | Stebley | 76/108.2 X |
| 3,918,138 | 11/1975 | Nemeth . | |
| 3,989,558 | 11/1976 | Mynard . | |
| 4,008,090 | 2/1977 | Miyake . | |
| 4,127,411 | 11/1978 | Yajima . | |
| 4,282,195 | 8/1981 | Hoekje . | |
| 4,359,335 | 11/1982 | Garner | 76/108.2 X |
| 4,469,654 | 9/1984 | Haskett . | |
| 4,617,056 | 10/1986 | Mosser . | |
| 4,692,418 | 9/1987 | Boecker . | |
| 4,711,144 | 12/1987 | Barr et al. | 76/108.2 |
| 4,753,305 | 6/1988 | Fisher | 76/108.2 X |
| 4,793,968 | 12/1988 | Mosser . | |
| 4,948,764 | 8/1990 | Newkirk . | |
| 5,061,661 | 10/1991 | Moyle . | |
| 5,064,788 | 11/1991 | Newkirk . | |
| 5,273,571 | 12/1993 | Mirchandani . | |
| 5,304,342 | 4/1994 | Hall . | |
| 5,342,564 | 8/1994 | Wei . | |
| 5,482,670 | 1/1996 | Hong . | |
| 5,694,640 | 12/1997 | Greetham | 419/38 |

*Primary Examiner*—Douglas D. Watts
*Attorney, Agent, or Firm*—Patnaude, Videbeck & Marsh

[57] ABSTRACT

An excavating tool has a tungsten carbide insert which is more wear resistant and not subject to breakage because of being too brittle. The insert has a semispherical tip, a divergent midsection and a base with a conical rear surface. The insert is made with tungsten carbide particles sized between 1 and 8 microns and averaging between 2 and 5 microns, blended with particles of a binder of which the binder comprises 5.5 to 6.5 percent of the blend by weight, and the insert is sintered to a hardness of 89.5 $R_a$ or more.

7 Claims, 5 Drawing Sheets

TOOL HAVING A TUNGSTEN CARBIDE INSERT

This is a continuation-in-part of my co-pending application filed Sep. 9, 1996 and bearing Ser. No. 08/709,310 pending.

The present invention relates to tools which are used to break up hard surfaces, and specifically to tools having metal bodies and cemented tungsten carbide cutting tips.

BACKGROUND OF THE INVENTION

Machines are available for breaking up and excavating hard surfaces such as concrete, stone and asphalt. These machines have a rotating member, such as a wheel or a drum, with a plurality of tools located on the outer surface of the rotating member. When the rotating member is forced against the surface to be excavated, the cutting ends of the tools successively impact against the surface to-be broken up, resulting in small amounts of material being removed by the impact of each tool.

The tools mounted on the rotating member have a generally concave seat at the forward end in which a tungsten carbide insert is retained. A forward cutting tip of the insert cuts into the surface to be excavated, and the useful life of the tool is determined by a number of factors. Ideally, the tip of the insert will wear evenly around its circumference and not crack or dislodge during use and, therefore, replacement will be needed only after the tool and the cutting tip are so worn as to be unusable. To maximize the resistance of the tool and the cutting tip to wear, it is desirable that the tungsten carbide cutting tip be made as hard as possible and yet not be so brittle as to break. It is also desirable that the braze which retains the tip in the seat be sufficiently strong so that the insert is not dislodged during use. The tungsten carbide insert is the most expensive portion of the manufacturing cost of such tools, and a large portion of the cost of the insert is in the raw material of which the insert is made. To be a competitive manufacturer of such tools, a manufacturing company must provide a tool having inserts that are not subject to being dislodged or cracked, and yet be competitively priced.

Currently, inserts of this type are manufactured from raw tungsten carbide powder having average particle sizes in the range of 8 to 18 microns with an average particle size midway between the extremes such that the particle distribution is in the shape of a bell curve. The raw material further includes from 6 to 11 percent by weight powdered cobalt, and after sintering, such inserts have a mean hardness which does not exceed 89.0 on the $R_a$ scale, and the hardnesses of the inserts have tolerances which are no more than ±0.5 $R_a$.

When a small percentage of cobalt, such as about 6 percent, is used with smaller particles of tungsten carbide, such as less than 8 microns, the resulting product may be harder, but more brittle than presently available inserts, and would be subject to fracturing. As a result, commercially available inserts are not made from particles of raw material having average particle sizes of tungsten carbide of less than 8 microns, and present day inserts have hardnesses which do not exceed 89.0±0.5 $R_a$.

It is well known that an insert having a greater hardness would have a significantly increased resistance to wear. Even a relatively modest increase in hardness, from 89.0 $R_a$ to 89.5 $R_a$, for example, would result in a lengthening of the life of the tool by twenty or thirty percent. Therefore, it would be desirable to provide a tool having a cemented tungsten carbide insert which has a longer usable life, without being subject to breakage. It would also be desirable to have an insert for which the cost of manufacture is reduced below existing costs.

BRIEF DESCRIPTION OF THE INVENTION

Briefly, there is provided in accordance with the present invention an excavating tool having an insert made of a grade of tungsten carbide which is harder than that currently usable in such tools but is not subject to the fracturing which has prohibited prior efforts to manufacture inserts from such harder grades of material. Three factors must be optimized to make a fracture resistant insert which is harder than existing inserts, and those factors are: the percentage by weight of cobalt, the particle sizes of the powdered raw material, and the shape of the insert itself.

The harder grades of tungsten carbide are generally more brittle because they usually contain lower percentages of the more elastic binder. Inserts made of cemented tungsten carbide which is harder than 89.0 $R_a$ have been unreliable because they shatter when subjected to the impacts of the insert against hard surfaces during use of the machine.

Although the qualities of tungsten carbide have been the subject of extensive study, and empirical data is available relating to the compressive limits and tensile limits (transverse rupture strength) there is no information as to how or where a tungsten carbide object will shatter when subjected to a powerful shock. Product testing has been used to determine that 89.0 $R_a$ is the hardest grade of tungsten carbide which can be used in existing designs of cutting inserts to cut the hardest materials for which the machines are used. Harder grades of tungsten carbide could be used on machines which cut softer materials, but tools for cutting the softer materials do not incur the wear to the insert suffered from the harder materials, although the steel bodies to which the inserts are mounted are more subject to being washed away.

When an axially symmetrical insert of a cutting tool fails, the failure often includes a break along a plane which is transverse to the axis of the insert, and is positioned adjacent the base. The inserts used in excavating machines for cutting through the hardest of materials have bases which are 0.610 to 0.750 inch in diameter depending on the manufacturer, and generally have a length of 0.600 or longer. Shorter inserts exist but they have been rarely used to cut hard surfaces because their usable life is too short. When existing configurations of inserts are made of tungsten carbide with a hardness greater than 89.0 $R_a$ and are subjected to the impacts failure occurs. The failure often includes a break which is transverse to the axis of the insert, and frequently this transverse fracture is very near the base, often only 0.125 inch or less above the top of the base portion which is brazed into the tool body.

The compressive strength of tungsten carbide is dependent on a number of factors but is normally about 600,000 lb/in$^2$ whereas the shear strength of the material is only about 200,000 lb/in$^2$. Tool failure, therefore, is much more likely to occur because the shear strength of the material is exceeded and not because the compressive strength is exceeded.

The tools mounted on rotating members for cutting hard surfaces have an attack angle, that is, the angle between a line perpendicular to the surface being cut and the axis of a tool, which is usually between 40 and 60 degrees. In accordance with the present invention, the length the insert is reduced, and the forward end, or tip end, of the insert is enlarged such that it has a proportionally larger cross-sectional diameter than the configurations of most existing inserts. When a tool mounted on the rotating member of a cutting machine impacts a surface at an attack angle of 40 to 60 degrees, a line perpendicular to the surface being cut and passing through the point of impact, will pass through or very near the base of the insert. The result of this configuration is that the forces within the insert caused by the tool striking the surface to be cut are predominantly compressive forces and not shear forces, and the tool will be less subject to failure.

An insert in accordance with the present invention which is suitable for use on a machine for cutting hard materials is symmetric about a principal longitudinal axis has a forward cutting end and is axially disposed behind the forward cutting end is a base. The body of the insert diverges outwardly from the forward cutting end toward the base. The base has a maximum diameter of about 0.700 inch and the insert has a length from the bottom of the base retained in the seat to the forward end of the insert of no more than 0.570 inch. The forward cutting end has a tip section having a largest diameter of about 0.375 inch, and between the tip section and the base is a diverging central section. The foregoing configuration of an insert is a mere 0.030 inch shorter than the inserts commonly used in such machines, but the shorter length gives the insert a greater strength and reduces the leveraging of the axial and shear forces which cause the insert to fail.

Prior art inserts have been manufactured with a forward cutting end consisting of a conical tip and a tapering midsection, and having an abrupt transition between the conical tip and the midsection. It has been found that the forces applied to compact the raw materials of the tungsten carbide during the manufacture of such inserts are not directed toward the center line of the insert and do not result in the highest compaction of the particles of the powdered raw material. Universal compaction is more important for the harder grades of tungsten carbide because they are made with lesser quantities of the cobalt binder. Poor compaction of the particles will, therefore, result in a weaker grade of tungsten carbide, and a higher likelihood of shattering.

Also, the stresses within an insert having a conical tip and an abrupt transition to the midsection are higher when the tool is used to break up hard surfaces, and inserts with such a configuration are more susceptible to fracturing. A semi-spherical tip and a blended transition to the central portion of the inserts of the present invention distribute the stresses of the impact of the tool more evenly through the body of the insert such that it is less susceptible to fracturing.

The seat at the forward end of the metal body has a cylindrical inner surface defining a wall, and a recessed conical surface having an included angle which is between 120 and 170 degrees, and is complementary to the included angle of the conical base of the insert. To assemble the insert to the tool, a conically shaped wafer of brazing material is fitted between the conical rearward surface of the insert and the complementary shaped recessed surface of the tool. The insert and the wafer are induction heated at about 10 khz to liquefy the braze material in the presence of a cleaning flux and the joint is formed when the brazing material is cooled.

To manufacture the insert of the present invention, a die is provided, the interior of which is shaped to form an outwardly tapering central section of an insert, and a first punch is provided having a semispherical cavity for forming the semispherical tip section of the insert. Similarly, a second punch is provided having an inwardly directed conical surface for forming a conical rear surface at the rearward end of the base of the insert. During the pressing process, the die is positioned with the narrow tip end downward and the base end upward. The tip punch is moved into the tubular tip end of the die to prevent the powder from pouring out. The die is filled with powdered material consisting of between 5.5 and 6.5 percent cobalt and 93.5 to 94.5 percent particles of tungsten carbide by weight, the tungsten carbide particles having sizes ranging from 1 to 8 microns and averaging between 2 and 5 microns. The first and second punches are then axially moved against the forward and rear portions of the die with sufficient force to compact the powder disposed within the die. The insert is then sintered to a hardness of 90.0±0.5 $R_a$ or harder.

The particle size of the tungsten carbide is the primary factor in determining the hardness of the sintered insert. Particle sizes ranging from between 3 to 8 microns and averaging 4 to 5 microns can be sintered to a hardness of about 90.0±0.5 $R_a$ whereas smaller particle sizes, when sintered, result in an even harder insert.

Although the particle sizes generally range between 1 and 8 microns and average from between 2 to 5 microns, it is not necessary that all the particles used to form an insert be of the same size, nor is it necessary that all the particles fall within the 1 to 8 micron range.

The semispherical indentation in the first punch used to form the tip section and the conical indentation of the second punch used to form the rearward surface of the base apply forces to the powder during the compressing process to more effectively compact the powder than the punches used to form prior art inserts. This is believed to occur because the compacting forces in the compressing process are better distributed through an insert of the present invention and less so for existing designs of inserts. The manufacture of inserts in accordance with the present invention will result in the more uniform compaction of the particles of tungsten carbide in the insert, even though the punches are applied with the same forces used to manufacture existing inserts.

The tungsten carbide particles are fused together during the sintering process when the particles of cobalt melt and fill the spaces between the tungsten carbide particles. Since the cobalt is softer than the tungsten carbide, and reducing the percentage of cobalt increases the hardness of the finished product.

When the insert is thereafter sintered, a hardness of 90.0±0.05 $R_a$ or harder can be reached, and the insert produced will be less susceptible to wear and no more susceptible breakage than presently available inserts. Tools having inserts of equal size constructed in accordance with the present invention have been found to have a useful life which is 150 percent or more times greater than the useful life of prior art inserts.

GENERAL DESCRIPTION OF THE DRAWINGS

A better understanding of the present invention will be had from a reading of the following detailed description taken in conjunction with the accompanying drawings wherein.

DETAILED DESCRIPTION OF THE PREFERRED EMBODIMENT

Figure 1:
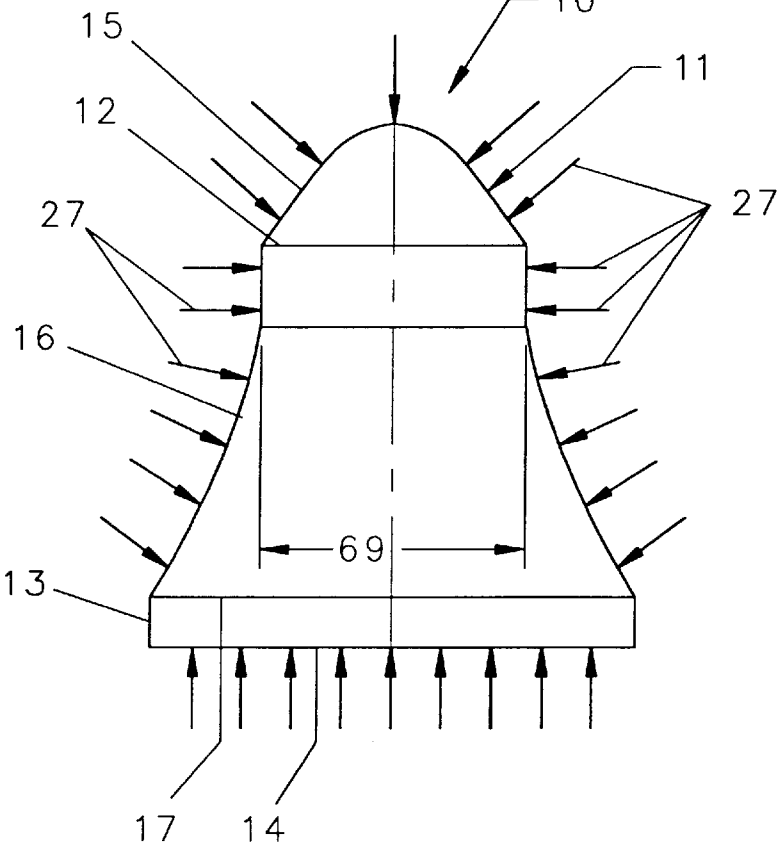
PRIOR ART FIG. 1
FIG. 1 is a front elevational view of an insert constructed in accordance with the prior art.

Referring to FIG. 1, an excavating tool constructed in accordance with the prior art includes an insert 10 having a forward cutting end 11 which is symmetrical about a central longitudinal axis. Axially aligned behind the forward cutting end 11 is a cylindrical base section 13 having a planar rear surface 14. The forward cutting end 11 comprises a conical tip section 15 and a diverging central section 16, between which is an abrupt transition 12. The rearward end of the central section 16 joins the forward end of the cylindrical base section 13 on a plane of intersection 17. The dimensions of the insert 10 are determined by the use for which it is intended, but the smallest inserts used for cutting the hardest surfaces have an overall length of at least 0.600 inch, and a diameter at the base of approximately 0.700 inch. Larger tips are made with this configuration, and the largest of the tips having an overall length of 13/16 inches and a maximum diameter of 0.750 inches.

Figure 2:
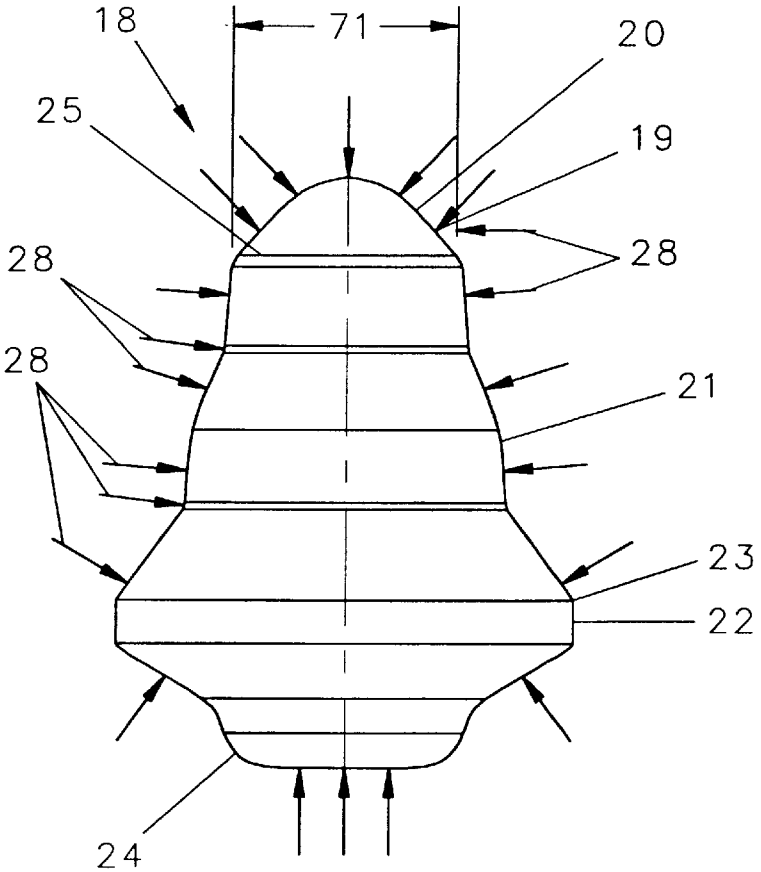
PRIOR ART FIG. 2
FIG. 2 is a front elevational view of a second insert constructed in accordance with the prior art.

A second commonly used insert for such tools is depicted in FIG. 2. The insert 18 has a forward cutting end 19, including a tip section 20 and a central section 21, between which is an abrupt transition 25. Positioned axially behind the cutting end 19 is a base section 22, with a plane of intersection 23 between the two. In this embodiment, the base section 22 has a bulbous lower surface 24 extending below a lower plane 26 of a cylindrical portion of the base.

There are two common sizes of inserts used by commercially available excavating machinery. The first has a base diameter of about 0.625 inch and the second has a base diameter of about 0.750 inch, and a length measured from the forward end of the tip section 20 to the lower plane 26, will vary but will be at least 0.600 inch.

Existing inserts 10 and 18 are manufactured by employing a generally tubular die the inner surface of which is complementary in shape to the central sections 16 and 21 into which powdered tungsten carbide is inserted. A first punch and a second punch are provided for compressing the conical tip section 15, 20 and rear surface of the base 13, 22, respectively.

During the operation of the punches, the powdered tungsten carbide, cobalt, and a wax binder are compressed as forces are applied perpendicular to the various outer surfaces of the insert as shown by the various arrows 27, 28 on FIGS. 1 and 2, respectively, which symbolize lines of force. As previously stated, it has been found that the maximum hardness that can be achieved, without excessive breakage, in an insert in accordance with the prior art having a configuration as shown in FIGS. 1 and 2, or any of numerous variations therefrom, is about 89.0 $R_a$. This is achieved by using a distribution of sizes of tungsten carbide particles ranging between 6 and 18 microns and averaging therebetween in a blend which includes 6 to 9 percent by weight of a binder of cobalt or nickel.

For the configuration of insert 10 in FIG. 1, the cylindrical base section 13 has a thickness, that is the longitudinal length between the plane of intersection 17 to the rearward surface 14, and for insert 18 in FIG. 2, between line 23 and lower plane 26, as measured at the outer edge of the base of at least 0.055 inch. When the base of an insert configured as insert 10 or insert 18 has a thickness at its maximum outer diameter which is less than 0.055 inch, it has been found that the insert may break during operation of the machine.

Figure 3:
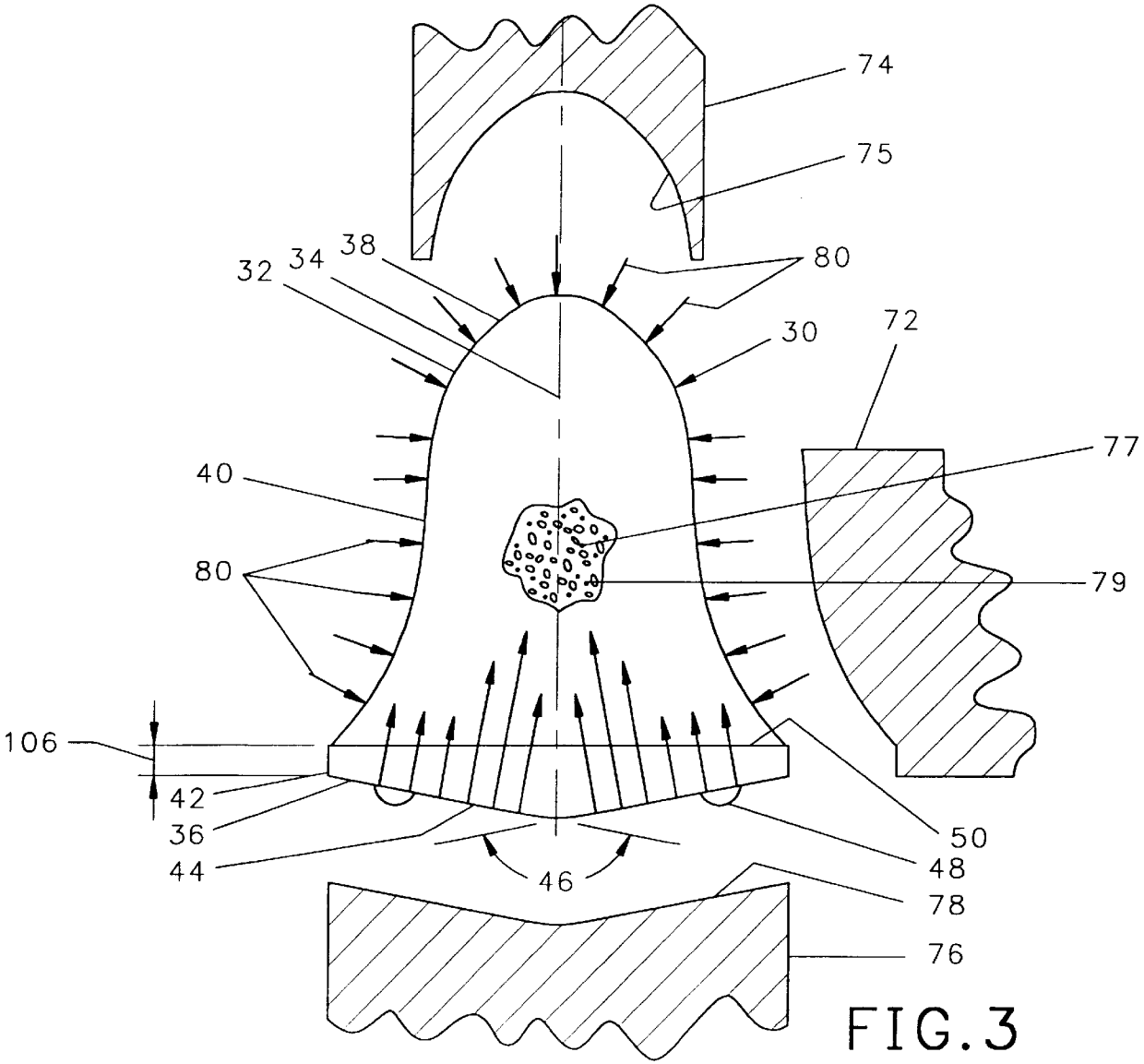
FIG. 3 is a front elevational view of an insert embodying the present invention showing portions of the die and punches used in its manufacture.

Referring to FIG. 3, a tool constructed in accordance with the present invention has an insert 30 having a forward cutting end 32 with a centrally located longitudinal axis 34, and axially disposed behind the forward cutting end 32 is a base section 36. The forward cutting end 32 includes a generally dome shaped or semispherically shaped tip section 38, and rearward of the tip section 38 is an outwardly diverging central section 40. Whereas the inserts 10 and 18 of the prior art had conical tip sections 15, 20 and abrupt transitions 12, 25 to diverging central sections 16, 21, the surface of the tip section 38 of insert 30 blends into the surface of the central section 40. There is no discernible line of transition at the surface; the tip section 38 being distinguishable from the central section 40 only by its semispherical shape.

The base section 36 of the insert 30 includes a cylindrical portion 42, and rearward of the cylindrical portion 42 is a conical rear surface 44. In the preferred embodiment, the conical rear surface 44 has an included angle 46 which is between 120 degrees and 170 degrees. A plurality of small protrusions or dimples 48 extend from the rear surface 44 to space the rear surface 44 from a complementary shaped surface in the seat of the tool to facilitate the brazing of the insert to the tool. The central section 40 joins the cylindrical portion 42 of the base 36 along a plane of intersection 50.

Figure 4:
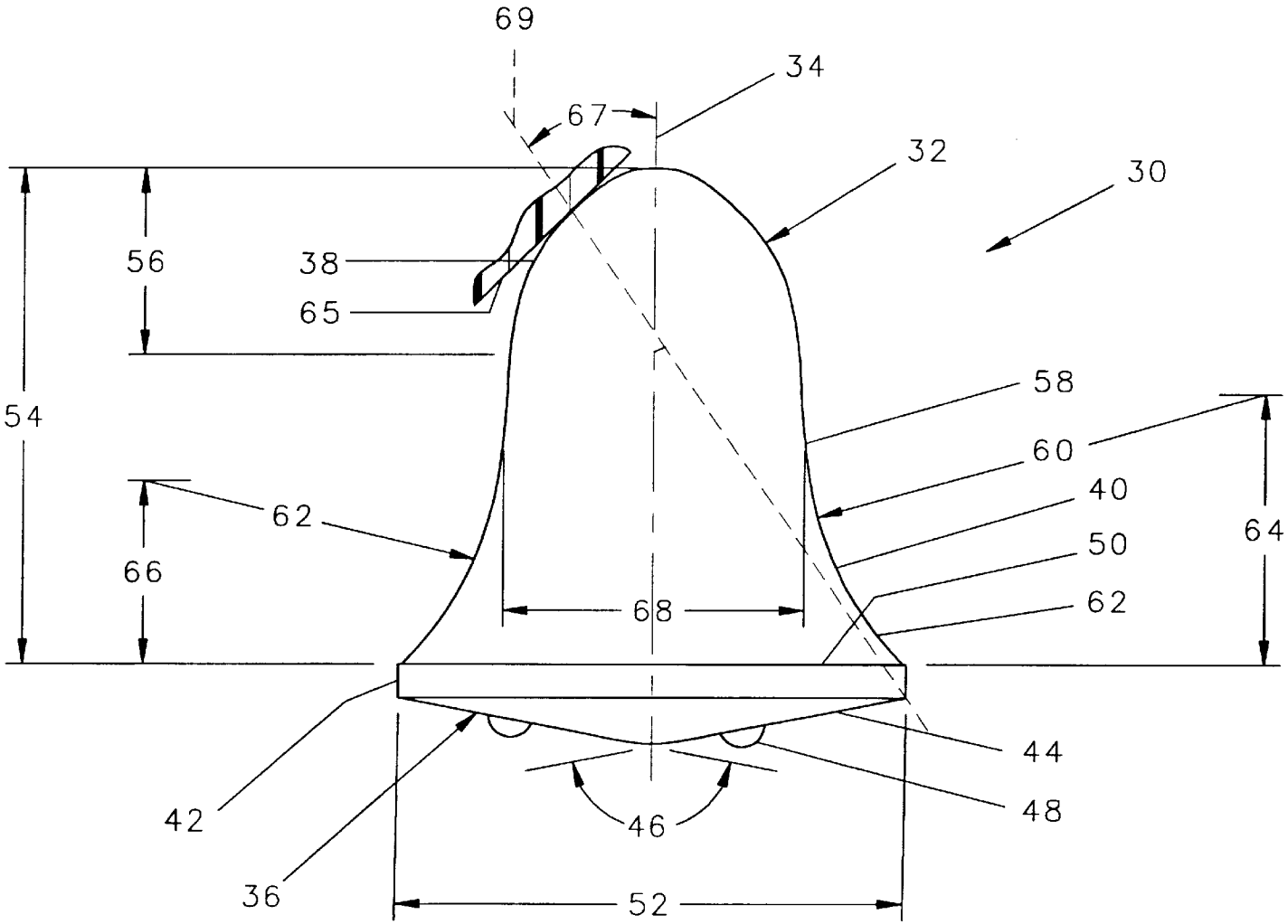
FIG. 4 is a second front elevational view of the insert shown in FIG. 3 with indicia numbers for the dimensions thereof.

Referring with more particularity to FIG. 4, in the preferred embodiment, the profile of the diverging central section 40 is defined by a curve composed of portions of two circles of different radii. Inserts used for excavating tools are manufactured to two common sizes. In the first of the sizes, the base section 36 has a diameter 52 of about 0.687 inch and the insert has a length 54 of about 0.570 inch or less with the curve of the tip section 38 commencing a distance 56 of about 0.220 from the forward end thereof. The curve of the central section 40 is composed of a forward curved section 58 having a radius 60 of about 0.965 inch and a rearward radius 62 of about 0.375 inch. In this embodiment, the center of the forward radius 60 is positioned a distance 64 which is 0.376 inch forward of the base 36, and the center of the rearward radius 62 is positioned a distance 66 which is about 0.30 inch forward of the base 36. At the intersection of the tip section 38 and central section 40, the insert 30 has a diameter 68 of about 0.390 inch which is a little greater than the cross-sectional diameter 69 and 71 of about 0.375 inch of the existing inserts shown in FIGS. 1 and 2.

In the second commonly used size, the base diameter 52 is about 0.625 inch, the length 54 is about 0.530 inch, the tip length 56 is about 0.220 inch, the radius 60 is about 0.790 inch, the radius 62 is about 0.375 inch, and distances 64 and 66 are about 0.327 and 0.288 inch, respectively. The maximum diameter 68 of the tip section in this embodiment is about 0.350 inch which is a little larger than the diameters 69 and 71 for comparably sized existing inserts 10 and 18 which are about 0.300 inch. The larger diameter 68 of the insert 30 near the tip section 38 provides better load distribution which is desirable when the tip 30 is made of a harder grade of tungsten carbide.

Also, as previously described, when the tip 30 strikes a hard surface 65 with an attack angle 67 which is between 40 and 60 degrees from the axis 34, the forces within insert 30 will be directed down a line 69 perpendicular to the plane of the surface 65 which will pass through the base 36, or nearly pass through the base, such that the impact is absorbed as a compressive force rather than a shear force.

Referring to FIG. 3, the insert 30 is manufactured by providing a generally tubular die 72, only a portion of which is depicted, which has an inner surface complementary in shape to the outer surface of the central section 40 and of the cylindrical portion 42. The semispherical tip section 38 is formed by a first punch 74 having a semispherical recess 75 in the end thereof which is complementary to the shape of the tip section 38. Similarly, the rear surface 44 of the base section 36 is formed by a second punch 76 having a recess defined by a conical surface 78 which is complementary in shape to the conical rear surface 44. Powdered tungsten carbide 77 and a powdered binder 79 of either cobalt or nickel, which are premixed together, are compacted within the die 72 by the punches 74, 76 pressing against the tip section 38 and rear surface 44, respectively, the punches 74, 76 being moved parallel to the longitudinal axis 34 of the insert to form a piece ready for sintering.

As previously discussed, the mixture of powdered raw materials including particles of tungsten carbide ranging between 1 and 8 microns in size with an average size of between 2 and 5 microns. The mixture also contains particles of cobalt or nickel which make up 5.5 to 6.5 percent by weight of the blend and a wax binder is thereafter added to retain the shape until the part is sintered.

When an insert 30 is constructed with an outwardly diverging central section 40, a generally domed or semispherical tip section 38, a conical rear section 44 and without an abrupt transition along the body of the insert as is depicted, the forces which compress the particles of powdered tungsten carbide are exerted perpendicular to the surfaces as shown by the various arrows 80. It has been found that when the first and second punches 74, 76 are configured as shown, the powdered tungsten carbide is more uniformly compacted and more densely compacted during the pressing process. The resulting product is an insert having the desired hardness of 90.0 $R_a$ to 91.0 $R_a \pm 0.5$ $R_a$.

Figure 5:
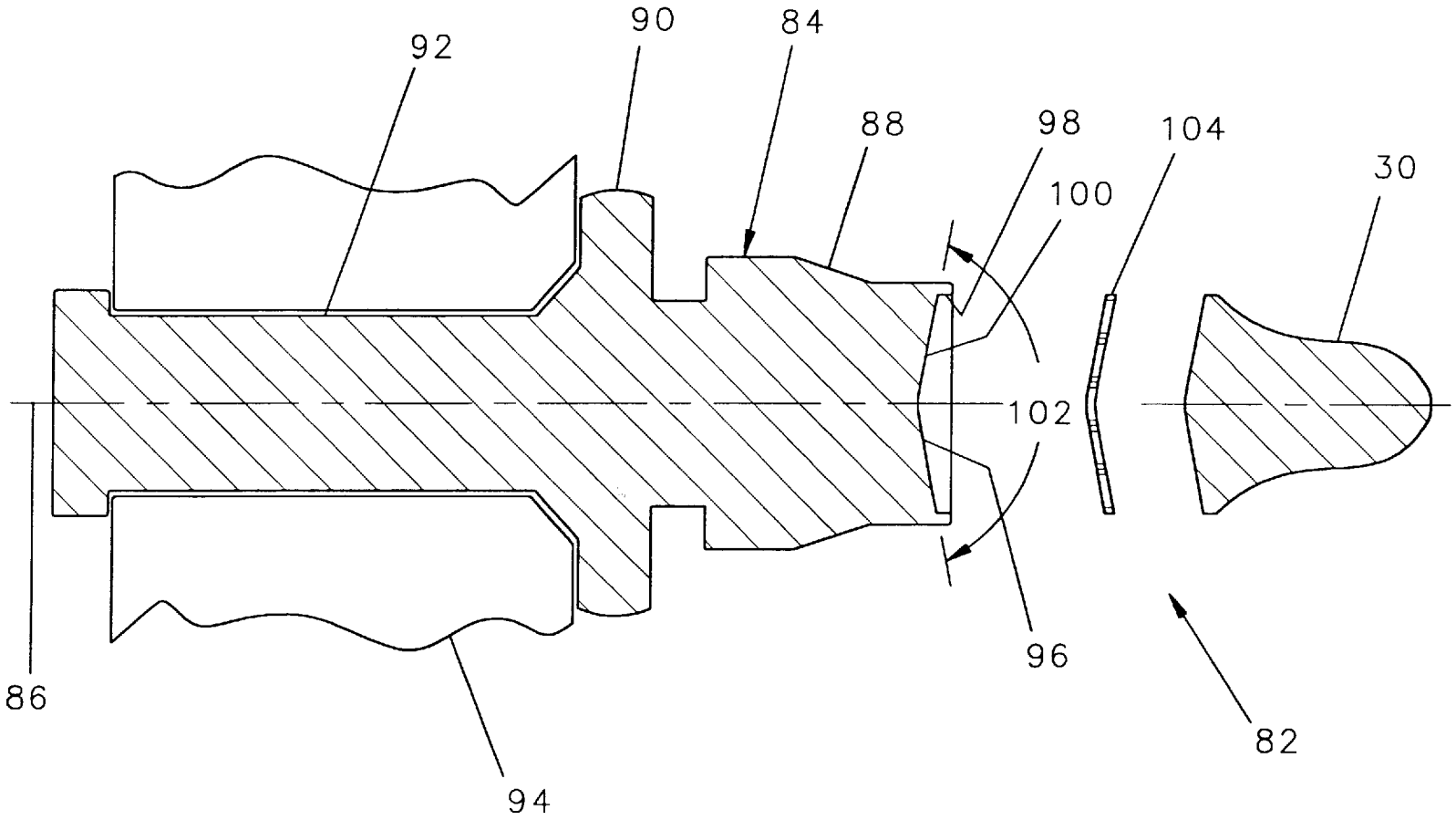
FIG. 5 is an exploded cross-section of a tool embodying the present invention and incorporating the insert of FIG. 3.

Referring to FIG. 5, in order to assemble a tool 82 in accordance with the present invention, the insert 30 is brazed to a steel tool body 84. The tool body 84 has a tapered forward section 88 which is symmetrical about the central longitudinal axis 86 thereof, and axially disposed behind the forward section 88 is an external annular flange 90. Axially disposed behind the flange 90 is a cylindrical mounting portion 92 which is rotatably retained in a tool holder 94.

At the forward end of the tapered forward section 88 is a seat 96 having a cylindrical inner wall 98 and a conical lower surface 100; the conical lower surface 100 has an included angle 102 complementary in shape to the included angle 46 of the insert 30.

In the preferred embodiment, the seat 96 is cold headed. Although there are limitations to the contours of a seat which can be cold headed, a seat having a wall and a lower surface with an included angle of 120 to 170 degrees can be cold headed.

To retain the insert 30 in the seat 96, a conical wafer of braze material 104 having an outer diameter which is a little less than the inner diameter of the cylindrical wall 98 is fitted against the lower surface 100. Thereafter, cleaning flux is applied to the parts, and the conical rear surface 44 of the insert 30 is fitted against the inner surface of the wafer 104. The insert 30 and the wafer 104 of braze material are then inserted into the seat 96, and the parts are induction heated at about 10 khz until the wafer 104 melts. The subsequent cooling of the tool brazes the insert 30 into the seat 96.

The braze which retains the insert to the forward end of the tool 84 fails when transverse forces and shear forces are applied to the tip 34 as a tool is forced into a hard surface exceed the strength of the braze. The shear or axial forces are leveraged by the height of the insert, and it is those leveraged forces which can break the braze and dislodge the insert. The length 54 of the insert, therefore, is also a factor in causing failure of the braze.

Existing inserts are manufactured with a height which is about ⅝ inch, and it has been found that an insert having such a height will wear down and under ideal conditions will have a useful life approximately equal to the useful life of the tool to which it is mounted.

Since inserts in accordance with the present invention are harder, and more wear resistant, they can be manufactured with a length 54 which is shorter than the length of existing inserts without reducing the useful life of the tool. The reduced length 54 of such inserts reduces the leverage applied by transverse forces to the base and to the braze and, therefore, significantly reduces the incidence of failure of the braze.

The raw materials used for the construction of the insert 30 is a substantial portion of the expense of manufacturing the tool. It is, therefore, desirable to provide an insert for which the volume of material used for the construction thereof to be minimized, while the physical size of the forward cutting end remains unchanged.

Referring further to FIG. 3, the volume of material used to form the base section 36 is minimized by providing that the cylindrical portion 42 of the base 36 has a maximum length of not more 0.050 inch and preferably between 0.035 and 0.045. That is to say, that at the peripheral edge of the cylindrical portion 42 of the base, where the thickness 106 is defined as the axial distance between the annular line of intersection 50 and the conical rear surface 44 at the peripheral edge thereof, is not more than 0.050 inch.

Figure 6:
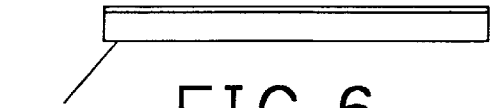
FIG.6 PRIOR ART
FIG. 6 is a fragmentary front elevational view of the insert of FIG. 1 showing only the base thereof.
Figure 7:
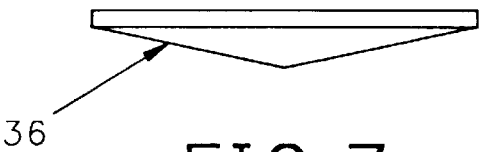
FIG. 7 is a fragmentary front elevational view of the insert of FIG. 3 showing only the base thereof.

For example, the insert 10 shown in FIG. 1 which has a cylindrical base 13, as also shown in FIG. 6, may have a total mass of 28.5 grams, while the base 13 thereof has a mass of 6.99 grams. On the other hand, the insert 30 shown in FIGS. 3 and 4, which has a forward cutting end with dimensions comparable to those of the insert 10, and having a base 36 with an included angle of 160 degrees, has a total mass of 24.5 grams. The base 36 of the insert 30, shown in FIG. 7, will have a mass of 4.85 grams. Even greater savings are achieved when the mass of the insert 30 is compared to that of insert 18. As can be seen, a tool having an insert in accordance with the present invention can be made with lesser quantities of tungsten carbide and can be made less expensively than tools which incorporate inserts in accordance with the prior art.

The base 36 is depicted in FIG. 3 as being cylindrical, and the measurement of thickness 106 is taken from the opposing edges of the cylindrical base portion 42. It should be appreciated that the intersection of the base portion 42 with the central section 40 is not necessarily a plane because the edge of the intersection may be rounded, as shown at 110 in FIG. 8. Similarly, the intersection of the base portion 42 with the conical rear surface 44 may also be rounded as shown at 112 in FIG. 8. If the curves 110 and 112 have large enough radii, the base portion 42 may not have any cylindrical surface, and for the purpose of measurement, the distance of measurement 106 is taken from the extensions of the central portion 40 and the extension of the rear surface 44 to the outermost diameter of the large diameter base portion 42.

Figure 8:
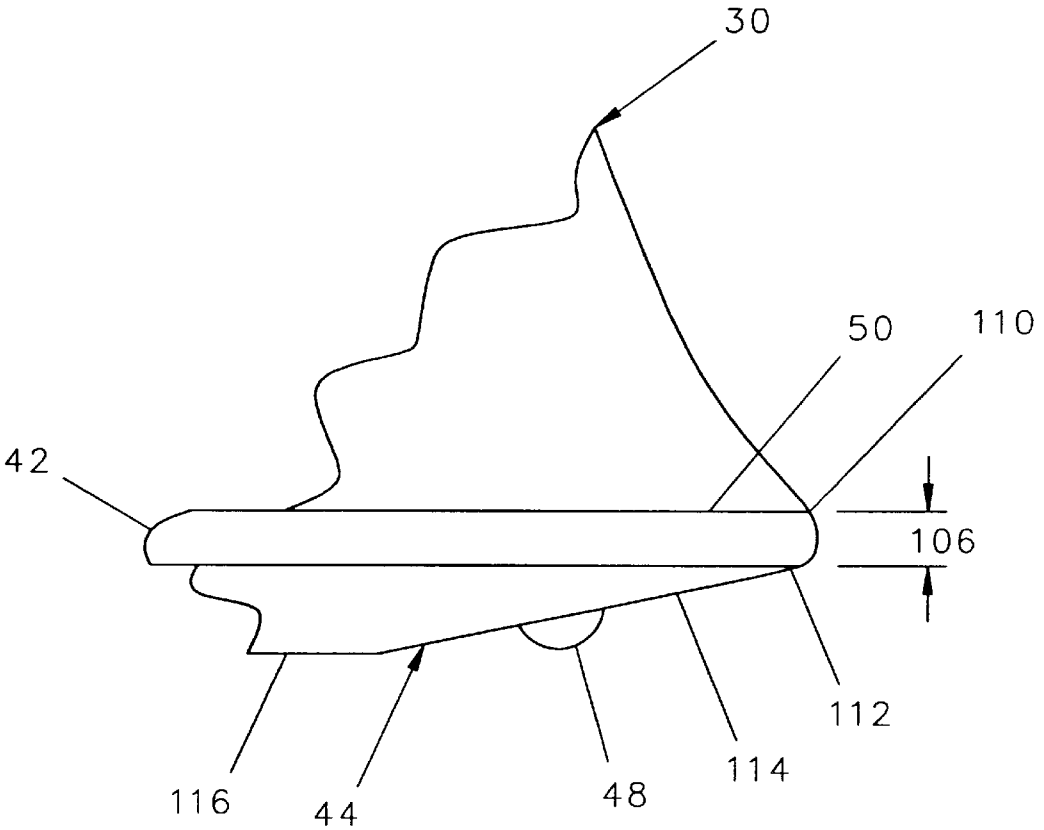
FIG. 8 is an enlarged fragmentary front elevational view of a second embodiment of an insert embodying the present invention.

As is also shown in FIG. 8, the rear surface 44 of the base portion 42 may have a frustoconical outer portion 114 and a planar central portion 116 oriented perpendicular to the axis 34 of the insert, and such a configuration would also result in a base having a reduced volume of material.

EXAMPLE

Inserts for tools were manufactured in accordance with the first of the common sizes described above from powdered tungsten carbide having grain sizes the majority of which ranged between 3 and 8 microns and having an average size of 4 to 5 microns. The tungsten carbide was blended with powdered cobalt such that the blend contained 6 percent cobalt by volume. Wax was added to the blend after which the blend was placed into a die and the punches for the tip and the base were used to apply 15 to 18 tons of pressure per square inch to compress the blends of powder to the desired shape. Thereafter, the green inserts were sintered in a furnace to 90.0±0.5 $R_a$. When the tools were brazed to tool bodies and placed in service cutting concrete under test conditions, the tools and inserts were found to have a useful life of about 150 percent or greater than that of existing inserts of comparable size.

While the present invention has been described in connection with several embodiments, it will be understood that many changes and modifications may be made without departing from the true spirit and scope of the invention, and it is intended by the appended claims to cover all such changes and modifications which come within the true spirit and scope of the invention.

What is claimed:

1. The method of manufacturing a cutting tool having a hardened insert attached to a metal body comprising the steps of, providing a die for forming a central section of an insert, said die being shaped to form an outward taper from a tip to a base of an insert formed therein, providing a first punch for forming a tip section, providing a second punch for forming a rear surface of a base, filling said die with a blend of powder including powdered tungsten carbide having a particle size ranging between 3 to 8 microns and a powdered binder comprising at least one of cobalt and nickel, compressing said first and said second punches against opposite ends of said die to form an insert having a tip section and a rear surface, sintering said insert to a mean hardness of at least 90.0 $R_a$, providing a tool having a forward end and a seat in said forward end with a seat complementary in shape to said rear surface of said base, providing a piece of braze material complementary in shape to said rear surface of said base, positioning said piece of braze material against said bottom of said seat and said rear surface of said insert against said piece of braze material and heating said braze material to braze said insert into said seat.

2. The method of claim 1 wherein said blend of powders contains no more than 6.5 percent binder by weight.

3. The method of manufacturing a cutting tool having a hardened insert attached to a metal body comprising the steps of, providing a die for forming a central section of an insert, said die being shaped to form an outward taper from a tip to a base of an insert formed therein, providing a first punch for forming a tip section, said first punch having a semispherical cavity therein for forming a semispherical tip section having an outer surface which blends into an outer surface of a central section formed by said die, providing a second punch for forming a rear surface of a base, said second punch having a frustoconical surface on at least the outer portion of a rear surface of a base, said frustoconical surface having an included angle of between 120 degrees and 170 degrees, filling said die with a blend of powder including powdered tungsten carbide having a particle size ranging between 1 to 8 microns and a powdered binder comprising at least one of cobalt and nickel, compressing said first and said second punches against opposite ends of said die to form an insert having a tip section and a rear surface, sintering said insert to a hardness of at least 90.0 $R_a$, providing a tool having a forward end and a seat in said forward end with a seat complementary in shape to said rear surface of said base, providing a piece of braze material, positioning said piece of braze material against said bottom of said seat and said rear surface of said insert against said piece of braze material and melting said braze material and subsequently cooling said braze material to braze said insert into said seat.

4. The method of claim 3 wherein said blend of powders contains no more than 6.5 percent binder by weight.

5. The method of claim 3 wherein said seat is formed by cold heading.

6. The method of manufacturing a tool having a metal tool body with a hardened insert at the forward end thereof comprising the steps of:

providing a tool body having a forward end, cold heading a seat into said tool body wherein said seat has an outer wall and a lower surface, said lower surface being generally conical in shape with an included angle of between 120 and 170 degrees, providing a die for forming a central section of an insert, said die being shaped to form an outward taper from a tip to a base of an insert formed therein, providing a first punch for forming a tip section, providing a second punch for forming a rear surface of a base, said second punch having a frustoconical surface on at least the outer portion of a rear surface of a base, said frustoconical surface having an included angle of between 120 degrees and 170 degrees, filling said die with a blend of powder including powdered tungsten carbide and a powdered binder comprising at least one of cobalt and nickel, compressing said first and said second punches against opposite ends of said die to form an insert having a tip section and a rear surface, sintering said insert, providing a piece of braze material, positioning said piece of braze material against said bottom of said seat and said rear surface of said insert against said piece of braze material and melting said braze material and subsequently cooling said braze material to braze said insert into said seat.

7. The method of claim 6 wherein said blend of powders contains no more than 6.5 percent binder by weight.

* * * * *